US010883723B2

(12) United States Patent
Yun et al.

(10) Patent No.: US 10,883,723 B2
(45) Date of Patent: Jan. 5, 2021

(54) INDUCTION HEATING COOKER AND METHOD OF CONTROLLING DISPLAY THEREOF

(71) Applicant: Samsung Electronics Co., Ltd, Suwon-si (KR)

(72) Inventors: Chang-Sun Yun, Suwon-si (KR); Hong-joo Kang, Suwon-si (KR); Dong-Oh Kang, Seoul (KR); Hee-joon Kang, Seoul (KR); Byung-hwan Ko, Suwon-si (KR); Hyun-kwan Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 284 days.

(21) Appl. No.: 15/958,929

(22) Filed: Apr. 20, 2018

(65) Prior Publication Data

US 2019/0195508 A1 Jun. 27, 2019

(30) Foreign Application Priority Data

Dec. 22, 2017 (KR) ..... 10-2017-0178502

(51) Int. Cl.

| | |
|---|---|
| ***H05B 6/06*** | (2006.01) |
| ***H05B 6/12*** | (2006.01) |
| ***F24C 7/08*** | (2006.01) |
| ***H01H 59/00*** | (2006.01) |
| ***F24C 7/06*** | (2006.01) |

(52) U.S. Cl.

CPC ..... *F24C 7/083* (2013.01); *F24C 7/067* (2013.01); *H05B 6/062* (2013.01); *H05B 6/1209* (2013.01); *H05B 6/1218* (2013.01); *H05B 2213/07* (2013.01)

(58) Field of Classification Search

CPC ..... F24C 7/083; F24C 7/067; H05B 6/062; H05B 6/1209; H05B 2213/07

USPC ..... 219/620, 621, 622, 624–627, 661, 662, 219/667, 600; 99/DIG. 14; 200/181

See application file for complete search history.

(56) References Cited

U.S. PATENT DOCUMENTS

2012/0118714 A1* 5/2012 Shigeoka ..... H03K 17/962 200/181

FOREIGN PATENT DOCUMENTS

| | | | |
|---|---|---|---|
| EP | 2247158 | A1 | 11/2010 |
| EP | 2579680 | A1 | 4/2013 |
| ES | 2633887 | T3 | 9/2017 |
| JP | 2005268208 | A | 9/2005 |
| JP | 2005-317305 | A | 11/2005 |

(Continued)

OTHER PUBLICATIONS

International Search Report dated Sep. 21, 2018 in connection with International Patent Application No. PCT/KR2018/004486, 3 pages.

(Continued)

*Primary Examiner* — Quang T Van

(57) ABSTRACT

An induction heating cooker includes at least one burner including a coil; a handling portion provided in a predetermined area separated from the burner, and including an input section for receiving a user's control and a first display for displaying information corresponding to the user's control; at least one second display provided in an area separated from the handling portion; and a controller configured to control the second display to display cooking information about the burner.

22 Claims, 13 Drawing Sheets

(56) References Cited

FOREIGN PATENT DOCUMENTS

| | | | |
|---|---|---|---|
| JP | 2007-018786 | A | 1/2007 |
| JP | 2010-218936 | A | 9/2010 |
| JP | 2010267478 | A | 11/2010 |
| JP | 2017-037706 | A | 2/2017 |
| KR | 10-2008-0067278 | A | 7/2008 |
| KR | 1020100093806 | A | 8/2010 |
| KR | 1020150029046 | A | 3/2015 |
| TW | 200505290 | A | 2/2005 |
| WO | 2012/164891 | A1 | 12/2012 |

OTHER PUBLICATIONS

Written Opinion of the International Searching Authority dated Sep. 21, 2018 in connection with International Patent Application No. PCT/KR2018/004486, 6 pages.

Supplementary European Search Report dated Oct. 29, 2020 in connection with European Patent Application No. 18 892 564.8, 7 pages.

* cited by examiner

INDUCTION HEATING COOKER AND METHOD OF CONTROLLING DISPLAY THEREOF

CROSS-REFERENCE TO RELATED APPLICATION AND CLAIM OF PRIORITY

This application is based on and claims priority under 35 U.S.C. § 119 to Korean Patent Application No. 10-2017-0178502 filed on Dec. 22, 2017 in the Korean Intellectual Property Office, the disclosure of which is incorporated herein by reference in its entirety.

TECHNICAL FIELD

Apparatuses and methods consistent with the embodiments relate to an induction heating cooker and a method of controlling a display thereof, and more particularly to an induction heating cooker capable of providing cooking information about a burner being heated and a method of controlling a display thereof.

BACKGROUND

As an electronic device generally used in heating food, there are a microwave oven, a heating-wire device and an induction heating appliance, etc.

The microwave oven is an appliance based on a principle of dielectric heating, and has been used the most. However, the microwave oven is generally used for warming something up, but not adequate for cooking since it has a limitation of a container and a low efficiency of about 50 percent.

The heating-wire device is an appliance of using conductive heat, and has no limitations of the container. However, the heating-wire device is short on output power as compared with a gas cooking device since it has a low efficiency of 60 percent and a restricted use of household electricity.

On the other hand, the induction heating appliance uses an eddy current to directly heat a container, and has a heat transfer efficiency of more than 90 percent, thereby having an advantage of reaching a high output power like that of the gas cooking device. Further, the induction heating appliance is safer than the gas cooking device since there is no need to catch a fire to cook, and provides a clean and pleasant kitchen environment to a user.

The induction heating appliance is difficult to recognize whether it is in use or not because a flame or a hot wire is not seen in an area of a burner being heated.

Further, most induction heating appliances are difficult for a user to recognize whether the burner operates or not since the area of the burner is spaced apart from an area of a handling portion.

SUMMARY

In accordance with an aspect of the disclosure, there is provided an induction heating cooker, which is easy for a user to recognize whether a burner operates or not, and a method of controlling a display thereof.

Further, in accordance with another aspect of the disclosure, there is provided an induction heating cooker, which provides various pieces of cooking information about a burner, and a method of controlling a display thereof.

According to an embodiment, there is provided an induction heating cooker comprising: at least one burner comprising a coil; a handling portion provided in a predetermined area separated from the burner, and comprising an input section for receiving a user's control and a first display for displaying information corresponding to the user's control; at least one second display provided in an area separated from the handling portion; and a controller configured to control the second display to display cooking information about the burner.

According to this embodiment of the disclosure, it is easy to recognize whether the burner being in use operates or not. Further, it is possible to provide various pieces of cooking information about the operating burner.

The induction heating cooker may further comprise a glass flat plate comprising a cooking area for the burner, and the second display may be provided below the glass flat plate. Thus, the display for displaying the cooking information is installed under the glass, thereby providing a structure improved in beauty.

The second display may be provided at a position spaced apart from the coil by more than a predetermined distance. Thus, parts of the display module are prevented from increasing in temperature due to heat generated by the coil while the burner is operating.

The at least one second display may be provided in each position corresponding to a relevant burner of at least one burner. Thus, it is possible to intuitively check the cooking information and determine whether the corresponding burner at a position near each burner.

The second display may comprise a display surface inclined at a predetermined angle to a horizontal surface of the cooking area for the burner. Thus, it is easy for a user to recognize the cooking information about each burner at a predetermined distant position, and an esthetically improved function is provided to a user.

The cooking information may comprise at least one among an output level, an output strength, a setting time, an operating time, a timer of the burner, a temperature of the burner, or a position of the burner. Thus, there is provided useful information such as the output, the operating time, the temperature, etc. of the operating burner.

The second display may represent the cooking information by a text comprising at least one of a numeral and a letter. Thus, in terms of displaying the cooking information about the burner, the cooking information may include various pieces of information.

The induction heating cooker may further comprise a third display of which display is variable in shape or type, and the controller may control the third display to be varied in shape or type of the display depending on the cooking information. Thus, an additional display module may be provided to represent a specific color or represent a flame or the like shape in accordance with the output levels of the burner.

The induction heating cooker may further comprise a communicator configured to communicate with a separate sensor, and the controller may receive the cooking information from the sensor through the communicator. Thus, information about temperature of food or temperature of a container may be displayed by communication with a wireless temperature sensor and the like.

The controller may set a color of the second display in accordance with a user's control received through the handling portion. Thus, a user can set by himself/herself a LED color of the display as desired.

The controller may change a color of the second display in accordance with the cooking information. Thus, the Led color of the display may be varied depending on the output level, the temperature and the like of the burner.

The second display may comprise a holder provided in a bottom thereof, and the holder may be inserted in an aluminum plate provided under the glass flat plate. Thus, the display module may be fastened to an appliance by inserting a holding structure provided in a lower side of the display module into an aluminum shield.

The second display may comprise a screw hole in a lower end portion thereof, and the second display may be fastened using a screw to an aluminum plate provided under the glass flat plate. Thus, a screw may be used to fasten the display module to an appliance.

The second display may be attached to an aluminum plate provided under the glass flat plate. Thus, the display module may be attached to the appliance by a double-sided tape and the like.

The controller may control the second display to alternately display the cooking information of the two or more burners. Thus, the cooking information about two or more burners is displayed on one display, and it is therefore possible to efficiently use the display module and reduce costs.

The induction heating cooker may further comprise a fourth display configured to display a local relation between the second display and the corresponding burner. Thus, when one display is used to display the cooking information about two or more burners, the LED module may blink so as to show what burner the cooking information being displayed corresponds to.

According to an embodiment, there is provided a method of controlling a display of an induction heating cooker that comprises at least one burner comprising a coil, a handling portion provided in a predetermined area separated from the burner, and comprising an input section for receiving a user's control and a first display, and at least one second display provided in an area separated from the handling portion, the method comprising: receiving the user's control for the at least one burner through the handling portion; displaying information corresponding to the received user's control on the first display; and displaying cooking information about the burner on the second display. According to this embodiment of the disclosure, it is easy to recognize whether the burner being in use operates or not. Further, it is possible to provide various pieces of cooking information about the operating burner.

The cooking information may comprise at least one among an output level, an output strength, a setting time, an operating time, a timer of the burner, a temperature of the burner, or a position of the burner. Thus, there is provided useful information such as the output, the operating time, the temperature, etc. of the operating burner.

The second display may represent the cooking information by a text comprising at least one of a numeral and a letter. Thus, in terms of displaying the cooking information about the burner, the cooking information may include various pieces of information.

The induction heating cooker may further comprise a third display of which display is variable in shape or type, wherein the method further comprises controlling the third display to be varied in shape or type of the display depending on the cooking information. Thus, an additional display module may be provided to represent a specific color or represent a flame or the like shape in accordance with the output levels of the burner.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 13, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, with reference to accompanying drawings, embodiments of the disclosure will be described in detail to be easily materialized by a person having an ordinary skill in the art to which the disclosure pertains. The disclosure can be materialized in various forms and not limited to the embodiments set forth herein.

Figure 1:
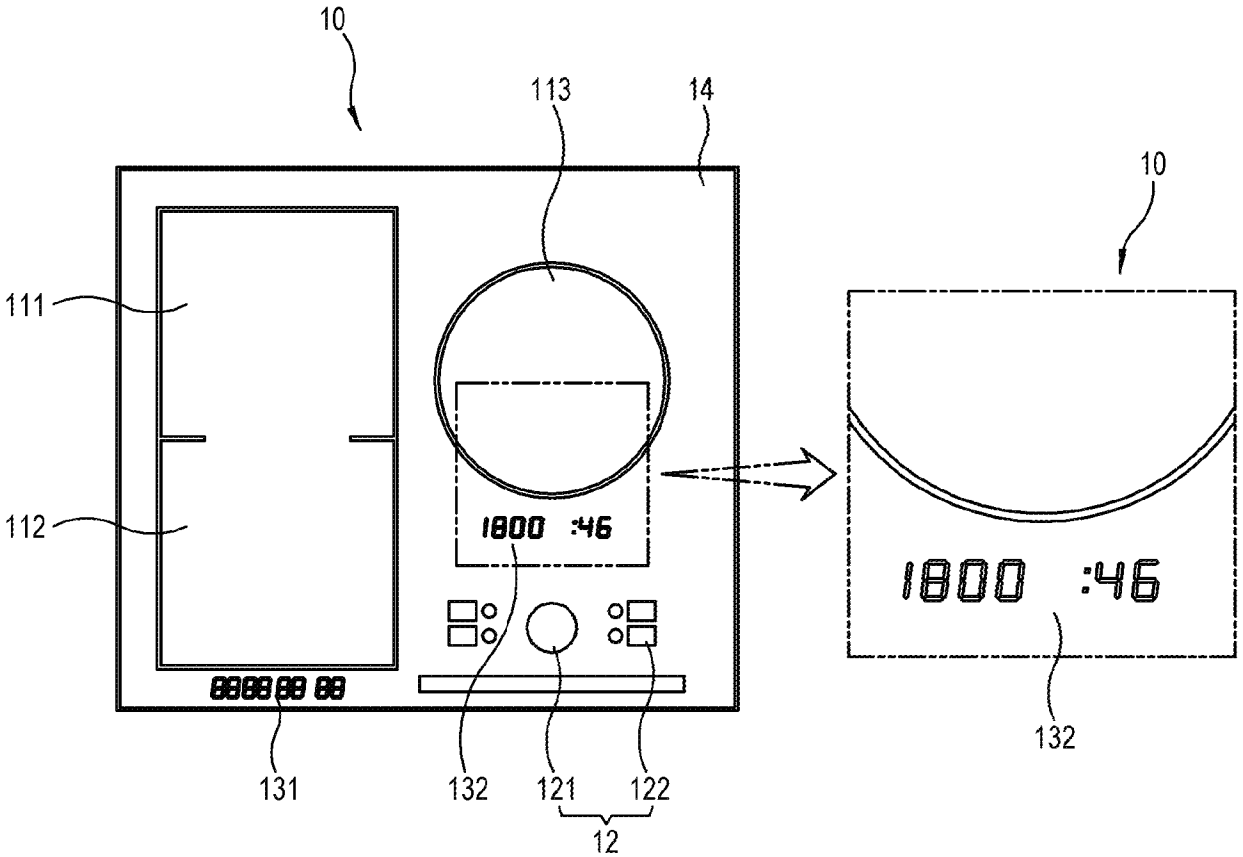
FIG. 1 illustrates a top view of an induction heating cooker of a three-burner model according to one embodiment of the disclosure.

FIG. 1 illustrates a top view of an induction heating cooker of a three-burner model according to one embodiment of the disclosure. As shown in FIG. 1, an induction heating cooker 10 according to the disclosure is an electric appliance that uses an eddy current to heat a container in three burners 111, 112 and 113 provided on a glass flat plate 14, and may for example be achieved by an induction cooktop. The induction heating cooker 10 adjusts the output, cooking time, etc. of the burners 111, 112 and 113 through an input section 121 in a handling portion 12, and displays some states such as an output, a residual heat, etc. on a first display 122 in the handling portion 12.

However, information displayed on the first display 122 shows only some states corresponding to a user's handling, and it is thus difficult to get more detailed information about a current cooking state.

Second displays 131 and 132 are provided in front of a first burner 111, a second burner 112 and a third burner 113, and placed in an area separated from the handling portion 12, thereby displaying more detailed cooking information than the first display 122. Here, the cooking information displayed on the second displays 131 and 132 may for example include at least one among an output level, an output strength, a setting time, an operating time, a timer, a temperature about each of the burners 111, 112 and 113, or a position of the burners 111, 112 and 113.

In the shown example, a second display 131 is provided corresponding to the first burner 111 and the second burner 112 at the left side, and a second display 132 is provided corresponding to the third burner 113 at the right side. In this case, the second display 131 may be materialized to alternately display the cooking information about each of the burners 111 and 112 so as to display the cooking information about two burners 111 and 112.

As described above, the induction heating cooker 10 according to the disclosure is capable of providing various pieces of cooking information about the operating burners 111, 112 and 113 through the second displays 131 and 132 installed separately from the handling portion 12. Further, through the second displays 131 and 132, a user can be easily informed of whether each of the burners 111, 112 and 113 operates or not.

Figure 2:
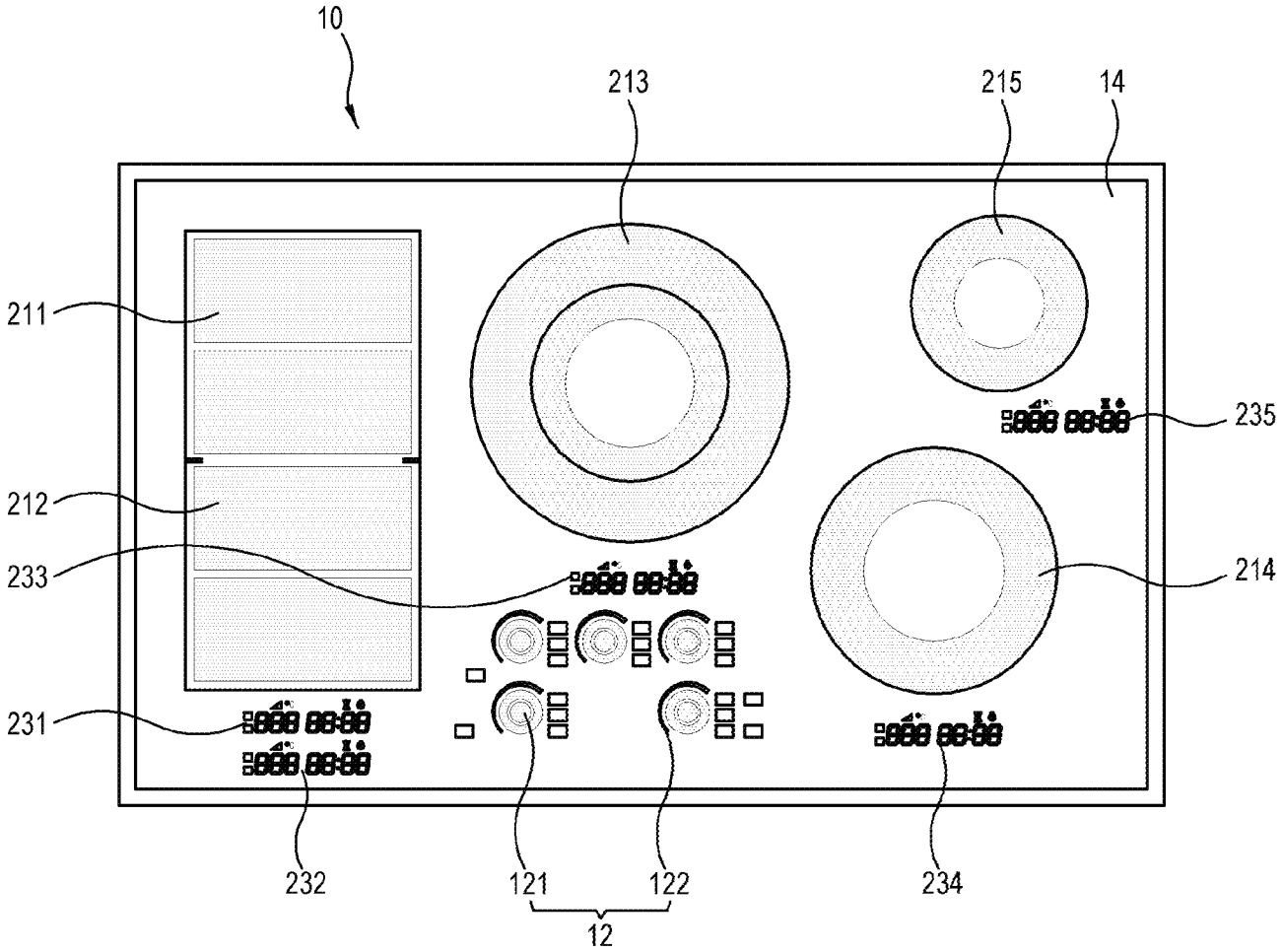
FIG. 2 illustrates a top view of an induction heating cooker of a five-burner model according to one embodiment of the disclosure.

FIG. 2 illustrates a top view of an induction heating cooker of a five-burner model according to one embodiment of the disclosure. As shown in FIG. 2, the induction heating cooker 10 according to one embodiment of the disclosure is materialized as an induction cooktop having five burners 211, 212, 213, 214 and 215.

In the induction heating cooker 10, the input section 121 in the handling portion 12 provided at a front center portion of the glass flat plate 14 receives a user's control for the burners 211, 212, 213, 214 and 215. When at least one among the burners 211, 212, 213, 214 and 215 operates in response to a user's control, states such as an output, a residual heat, etc. are displayed around the input section 121, for example, on the first display 122 materialized as an LED module.

The induction heating cooker 10 displays detailed cooking information about each operation of the burners 211, 212, 213, 214 and 215 on second displays 231, 232, 233, 234 and 235 provided in areas separated from the handling portion 12. The second displays 231, 232, 233, 234 and 235 are provided corresponding to the burners 211, 212, 213, 214 and 215, respectively.

In the shown example, the second displays 231 and 232 are arranged together in a front of the burners 211 and 212, in which the second display 232 positioned in a relatively forward portion corresponds to a second burner 212, and the second display 231 positioned in a relatively backward portion corresponds to a first burner 211.

Further, the second displays 233, 234 and 235 are arranged in respect fronts of the third burner 213, the fourth burner 214 and the fifth burner 215, and display the cooking information about the burners 213, 214 and 215, respectively.

The cooking information may for example include at least one among the output level, the output strength, the setting time, the operating time, the timer and the temperature of the burners 211, 212, 213, 214 and 215, or the positions of the burners 211, 212, 213, 214 and 215. In this case, the output strength includes at least one of a target output and an actual output, and the timer includes at least one of an elapsed time and a remaining time with respect to the setting time for cooking. Besides, the cooking information displayed on the second displays 231, 232, 233, 234 and 235 may provide additional information needed for a user in relation to the burners 211, 212, 213, 214 and 215 when the induction heating cooker 10 is used, without being limited to the embodiment of the disclosure.

According to one embodiment, when the burners 211, 212, 213, 214 and 215 are different in output power from one another, the second displays 231, 232, 233, 234 and 235 may display the different levels of the output power before receiving a user's control. In this case, a user may select and use one of the burners 211, 212, 213, 214 and 215, which is suitable for a cooking material and a cooking condition, with reference to information about the displayed levels of the output power.

According to one embodiment, the second displays 231, 232, 233, 234 and 235 may use a seven-segment display for displaying the cooking information. The seven-segment display is a numeral indicator that uses seven elements at most to represent numerals. For example, the numeral of '8' is represented when seven segments are all turned on.

In terms of displaying the cooking information, the second displays 231, 232, 233, 234 and 235 may represent not only a numeral using seven segments as described above, but also a text using letters or combination of a numeral and a letter. Besides, the cooking information may be represented using an image or the like as well as the text and the numeral, without limitations to the representation.

According to one embodiment, in terms of a function of the timer, the induction heating cooker 10 may further include a buzzer, a loudspeaker or the like to output a specific audio sound when it reaches a target time set by a user.

As described above, the induction heating cooker 10 according to the disclosure makes a user be intuitively informed of various pieces of cooking information about the burners 211, 212, 213, 214 and 215 through the second displays 231, 232, 233, 234 and 235 installed separately from the handling portion 12.

Below, the elements of the induction heating cooker 10 according to the disclosure will be described in detail with reference to FIGS. 3 to 7.

Figure 3:
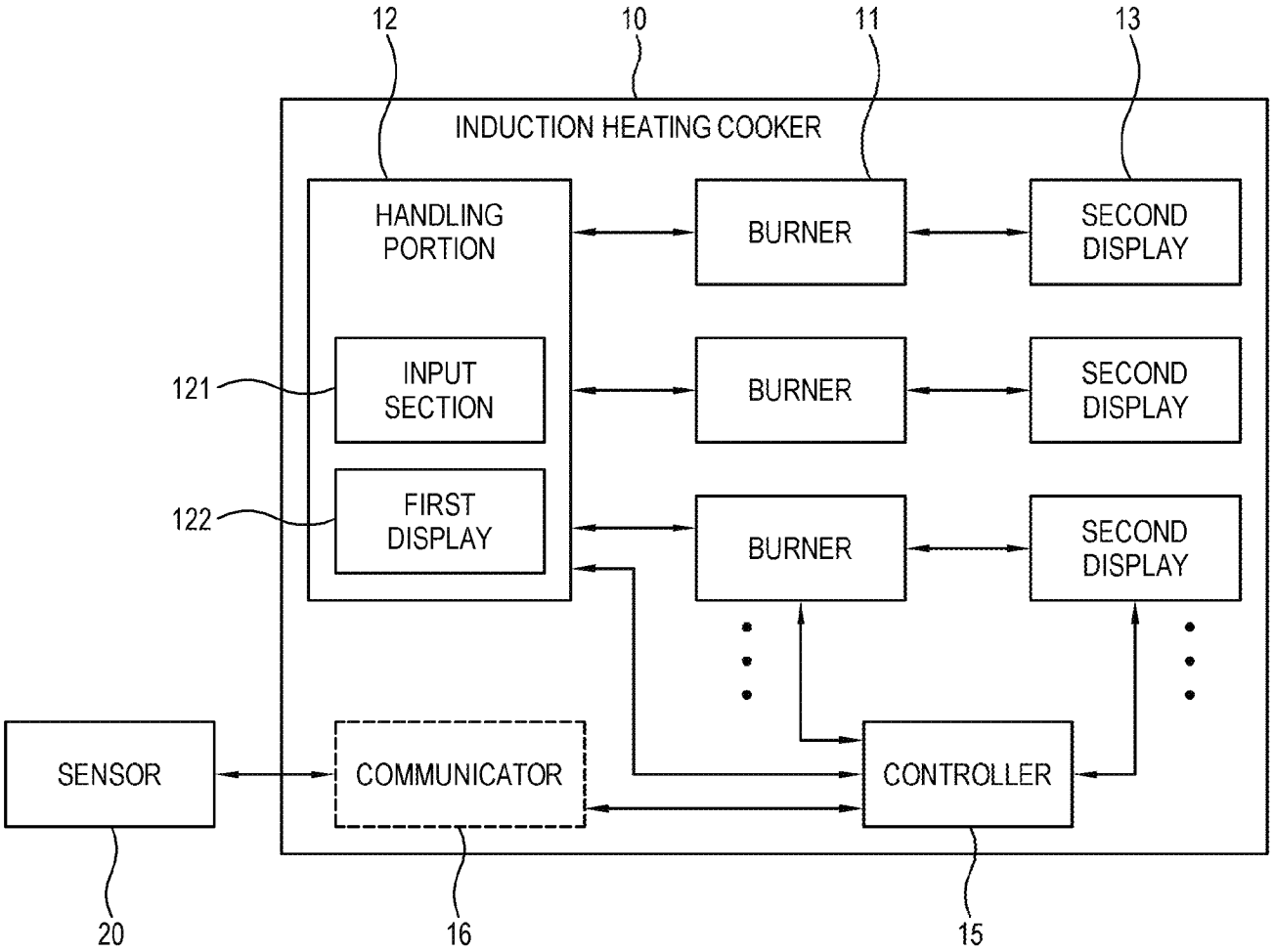
FIG. 3 illustrates a block diagram of an induction heating cooker according to one embodiment of the disclosure.

FIG. 3 illustrates a block diagram of an induction heating cooker according to one embodiment of the disclosure. As shown in FIG. 3, the induction heating cooker 10 according to the disclosure includes at least one burner 11, the handling portion 12, at least one second display 13, and a controller 15, and may be for example materialized as an induction cooktop. The induction heating cooker 10 may additionally include a communicator 16. In this case, the induction heating cooker 10 may communicate with an external sensor 20 through the communicator 16. The elements included in the induction heating cooker 10 are not limited to this embodiment of the disclosure, but may include additional other elements.

At least one burner 11 each includes a cooking area on which a container is put on, and a coil (refers to '41' of FIG. 4) placed under the cooking area and providing a heat source at a position corresponding to the cooking area. When input electric power is supplied to the burner 11 in response to a user's control, the coil 41 generates a resonance voltage and induces an eddy current to the container, thereby heating the container.

The handling portion 12 is provided in a predetermined area separated from at least one burner 11, and performs a function of controlling an operation of at least one burner 11 in response to a user's control. The handling portion 12 includes the input section 121 for receiving a user's control, and the first display 122 for displaying information corresponding to the user's control. The input section 121 may receive a user's control in various ways such as pressing, touching, clicking, turning, etc. and may be for example materialized by a control knob, a key, a button, a touch pad, etc.

The first display 122 may be provided in an area distinguishable from the input section 121 within the handling portion 12 and along the circumference of the input section 121. The first display 122 may be for example materialized by light emitting diodes (LED). The first display 122 displays state information about the corresponding burner 11 in response to a user's control received in the input section 121. For example, the first display 122 may represent the output level or the residual heat of the operating burner 11 with a predetermined shape, color, etc. in response to a user's control.

At least one second display 13 is displayed in a separate area divided from the handling portion 12, and provided at a position corresponding to the corresponding burner 11 among one or more burners 11. In other words, unlike the first display 122 provided within the handing portion 12, the second display 13 is arranged at a position corresponding to each burner 11, for example, in a front of the burner 11, and makes a user be easily and intuitively informed of the cooking information about the corresponding burner 11.

The second display 13 may be for example variously materialized by a plasma display panel (PDP), a liquid crystal display (LCD), an organic light emitting diode (OLED), a flexible display, etc. without limitations.

Figure 6:
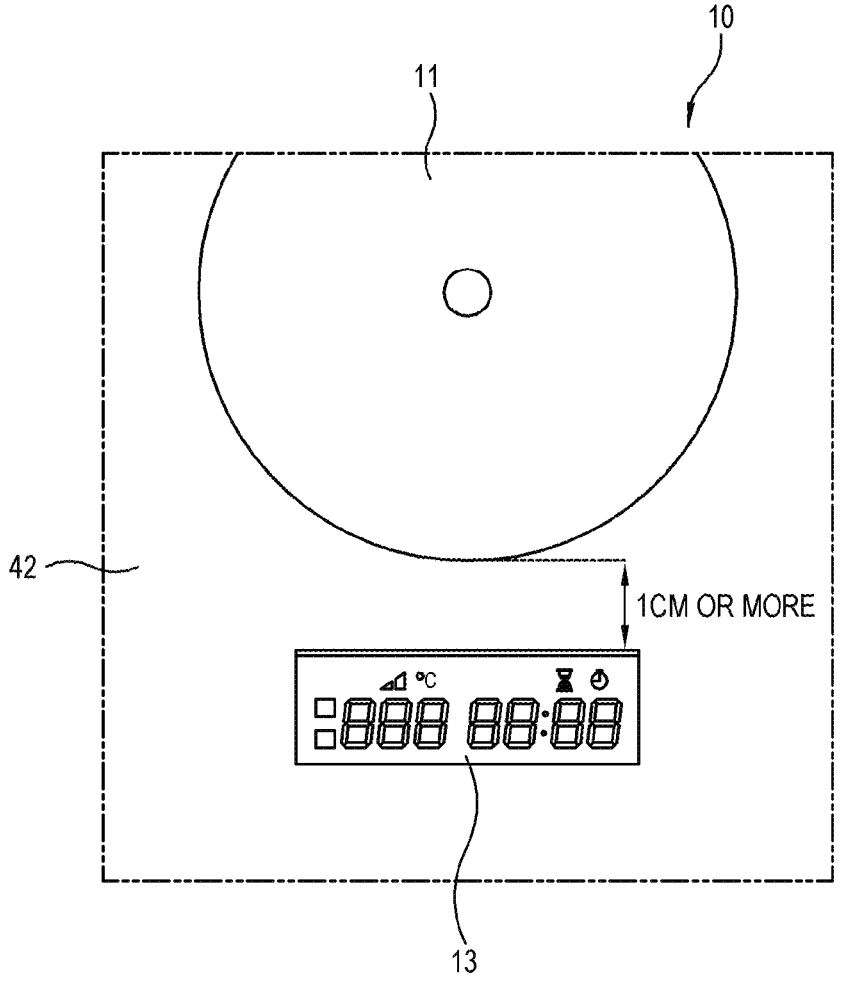
FIG. 6 shows an example of an arrangement between a burner and a display module according to one embodiment of the disclosure.

As shown in FIG. 6, the second display 13 is installed below the glass flat plate 14 at a position spaced apart at a predetermined distance or more from the burner 11. Specifically, the second display 13 may be installed at a position spaced apart at a predetermined distance, for example, 1 cm or more from the coil 41 of the burner 11 so as not to be affected by heat generated from the coil 41.

Figure 4:
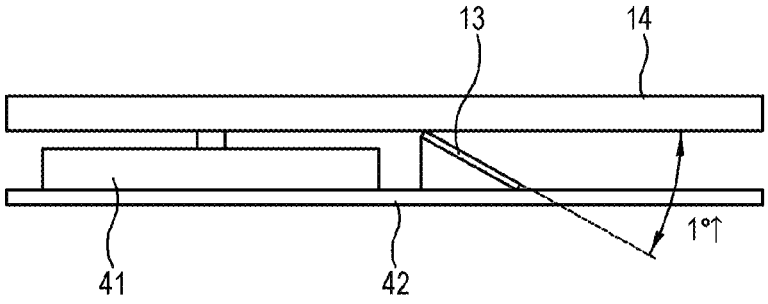
FIG. 4 illustrates a cross-sectional view of an induction heating cooker according to one embodiment of the disclosure.

As shown in FIG. 4, the second display 13 may be inclined at a predetermined angle to a horizontal surface of the cooking area of the burner 11. According to one embodiment, the second display 13 may be placed below the glass flat plate 14 and inclined at an angle of 1 or more degrees to the glass flat plate 14. Specifically, the second display 13 is installed to have an inclined structure on an aluminum plate 42 provided below the glass flat plate 14. In this case, the second display 13 is positioned at a predetermined distance from the coil 41.

With this inclined structure, a user can easily recognize the displayed cooking information at a position distant by more than a predetermined distance. Alternatively, the second display 13 may be installed on a flat surface at an angle of 0 degrees to the glass flat plate 14 so as to be easily mounted.

The controller 15 controls the second display 13 to display the cooking information related to the burner 11.

The cooking information may for example include at least one among the output level, the output strength, the setting time, the operating time, the timer, the temperature of the burner 11, or the position of the burner 11. In this case, the output strength includes at least one of a target output and an actual output, and the timer includes at least one of an elapsed time and a remaining time with respect to the setting time for cooking.

According to one embodiment, the controller 15 may control the second display 13 to display the cooking information about the output and time among the operations of the burner 11, and display the temperature of the glass flat plate 14 corresponding to the position of the burner 11 when the operation of the burner 11 terminates. In this case, a user intuitively recognizes the temperature of the glass flat plate 14, and it is thus possible to improve safety.

Alternatively, when the residual heat remains in the glass flat plate 14 corresponding to the position of the burner 11, the second display 13 may blink while displaying the temperature so as to warn a user against danger.

In terms of displaying the temperature, the second display 13 may use at least one of Celsius and Fahrenheit to display temperature, or may use a method desired by a user to display the temperature.

In terms of displaying the cooking information, the second display 13 may for example change the cooking information in units of several seconds. In this case, the kind of cooking information to be displayed on the second display 13 may be increased or decreased.

The second display 13 may display the cooking information about two or more burners 11 on one second display 13. In this case, the second display 13 may also display the information about the position of the burner 11 so that a user can know which burner 11 among two or more burners 11 the cooking information is related to. For example, as shown in FIG. 1, the second display 131 may display cooking information about at least one of the first burner 111 and the second burner 112 in a flex zone. In this case, the displayed cooking information may include information about whether it corresponds to one of the front second burner 112 and the rear first burner 111, or it corresponds to both the first burner 111 and the second burner 112.

Besides, the cooking information displayed on the second display 13 may further include various pieces of additional information related to the burner 11 without being limited to the embodiment of the disclosure.

According to one embodiment, the induction heating cooker 10 may further include a communicator 16, and receive additional cooking information from the outside.

The communicator 16 communicates with the external sensor 20 by a wired or wireless communication method. The sensor 20 may be for example materialized by a wireless temperature sensor. The communicator 16 may use wireless fidelity (Wi-Fi), Bluetooth or the like wireless communication method to communicate with the sensor 20. For example, the communicator 16 may be provided as a printed circuit board (PCB) including a wireless communication module such as a Wi-Fi module. The communicator 16 may use another communication method to communicate with the sensor 20 without limitations to the foregoing communication method.

Figure 9:
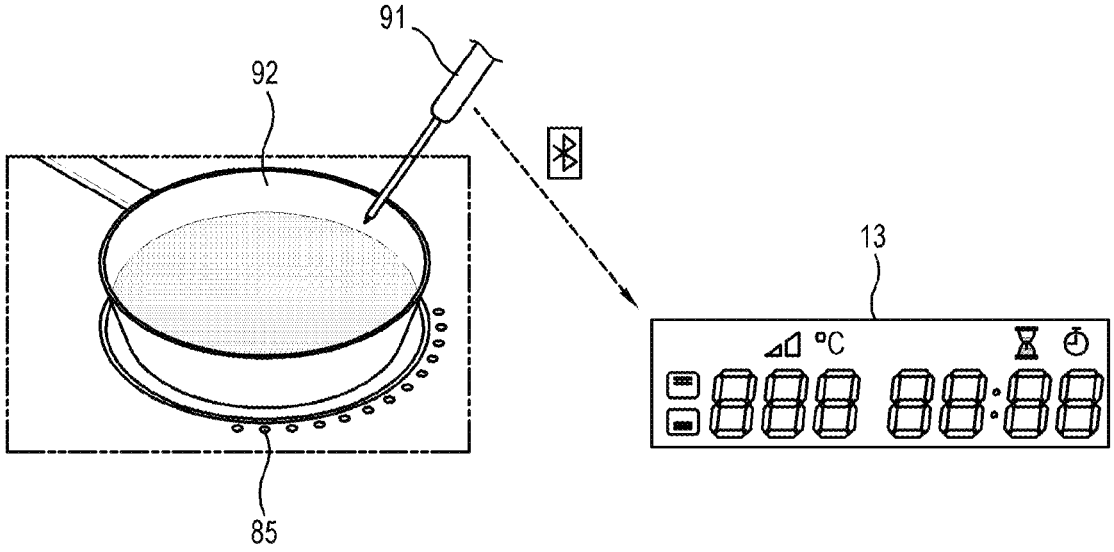
FIG. 9 shows an example of displaying a temperature of a container on a display by interconnecting with a temperature sensor according to one embodiment of the disclosure.

According to one embodiment, the controller 15 may receive cooking information from the sensor 20 through the communicator 16, and control the second display 13 to display the received cooking information. For example, as shown in FIG. 9, a wireless temperature sensor 91 may be mounted to a container 92 to be heated, and information about the temperature of the container 92 measured by the wireless temperature sensor 91 may be received through Bluetooth. Thus, the second display 13 may display an actual temperature of the container 92 being heated by the burner 11. Alternatively, the wireless temperature sensor 91 may sense the temperature of food filled in the container 92 instead of the temperature of the container 92, and transmit the sensed temperature to the second display 13 through Bluetooth.

According to one embodiment, the induction heating cooker 10 according to the disclosure may further include a third display 85 that employs an LED module to represent various colors in the form of the virtual flame. In this case, the controller 15 may control the third display 85 to display information about the temperature of the container 92, which is measured by the wireless temperature sensor 91, with a specific color.

With this configuration, the induction heating cooker 10 according to the disclosure makes a user easily recognize whether the burner being in use operates or not, and provides various pieces of cooking information about the operating burner.

Figure 12:
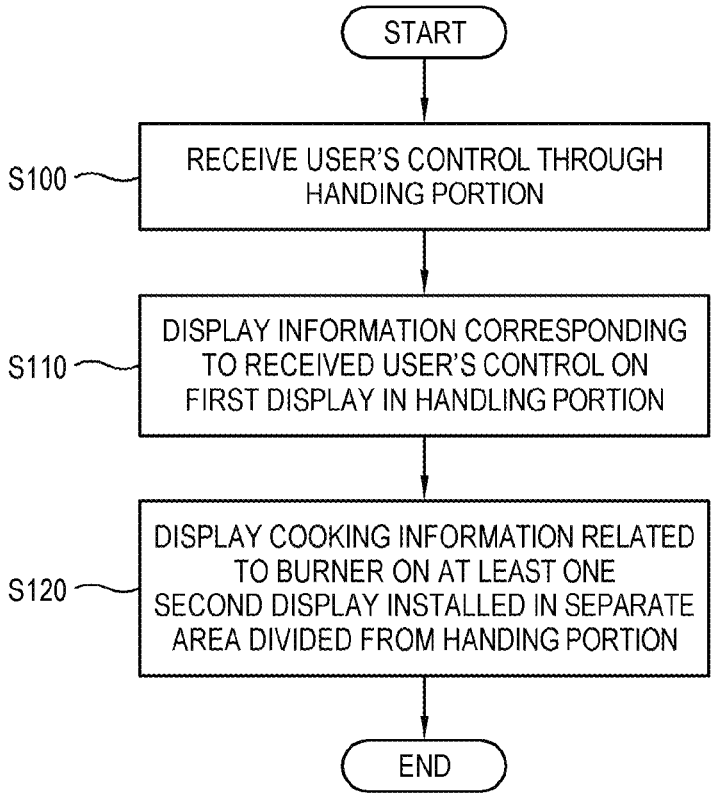
FIG. 12 illustrates a flowchart of a method of controlling a display in an induction heating cooker according to one embodiment of the disclosure.

The operations of the controller 15 may be illustrated as the flowchart of FIG. 12. As shown in FIG. 12, first, at operation S100, a user's control for at least one burner 11 is received through the handling portion 12. Next, at operation S110, the first display 122 in the handling portion 12 displays information corresponding to the received user control. In this case, the information displayed on the first display 122 may include the output power of the burner 11 corresponding to a user's control or information about the display of the residual heat, which can be represented by a numeral, a predetermined pattern and a color.

Last, at operation 5120, at least one second display 13 installed in a separate area divided from the handling portion 12 displays the cooking information related to the burner 11. Here, the cooking information may include at least one among the output level, output strength, the setting time, the operating time, the timer of the burner 11, the temperature of the burner 11, or the position of the burner 11, which may be represented by at least one of a numeral, a text and an image.

Figure 5:
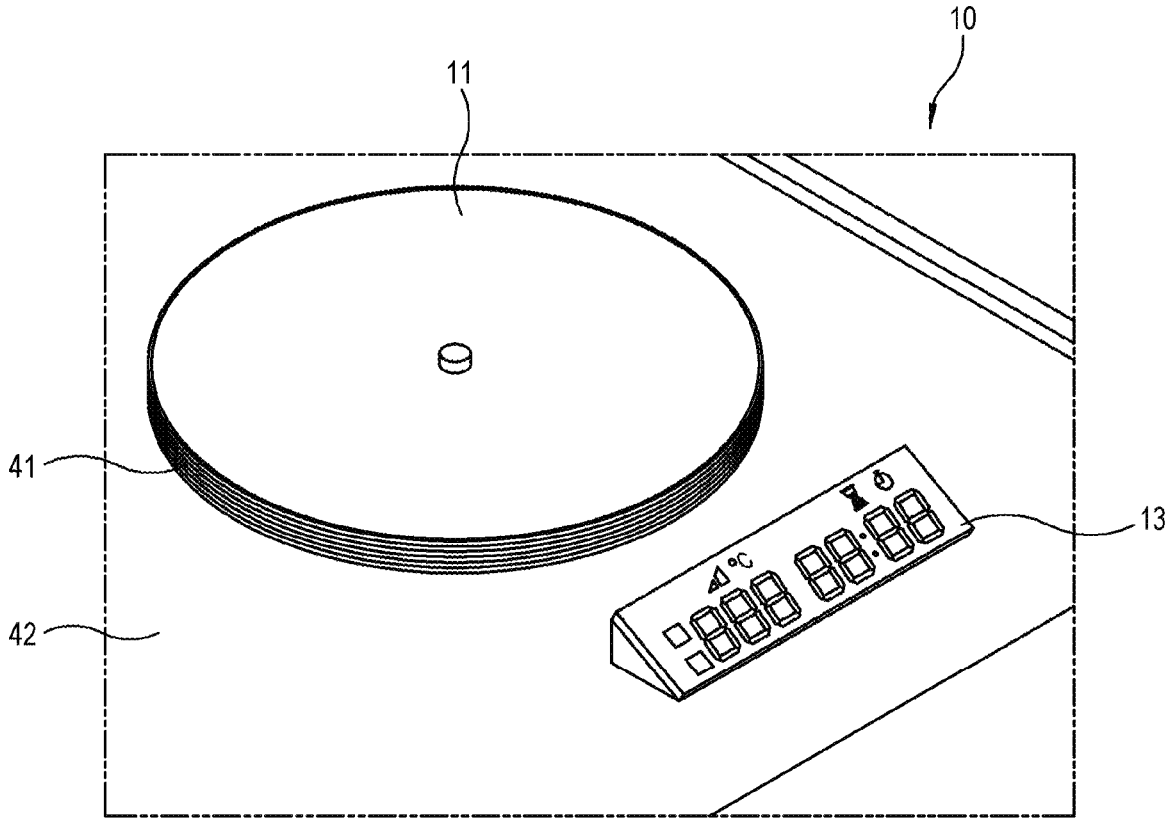
FIG. 5 illustrates a perspective view of showing an inner structure of an induction heating cooker according to one embodiment of the disclosure.

FIG. 5 illustrates a perspective view of showing an inner structure of an induction heating cooker according to one embodiment of the disclosure. As shown in FIG. 5, the induction heating cooker 10 is achieved by mounting the coil 41 and the second display 13 of the burner 11 on to the aluminum plate 42 placed under the glass flat plate 14.

The second display 13 is provided to have an inclined structure on the aluminum plate 42. The display surface of the second display 13 is inclined at a predetermined angle to the glass flat plate 14 where the cooking area of the burner 11 is provided.

According to one embodiment, the second display 13 can be installed on the aluminum plate 42 by the following three patterns. Besides, various patterns are possible.

First, a holder (not shown) is additionally provided below the second display 13, and inserted in the aluminum plate 42, thereby holding the second display 13.

Figure 13:
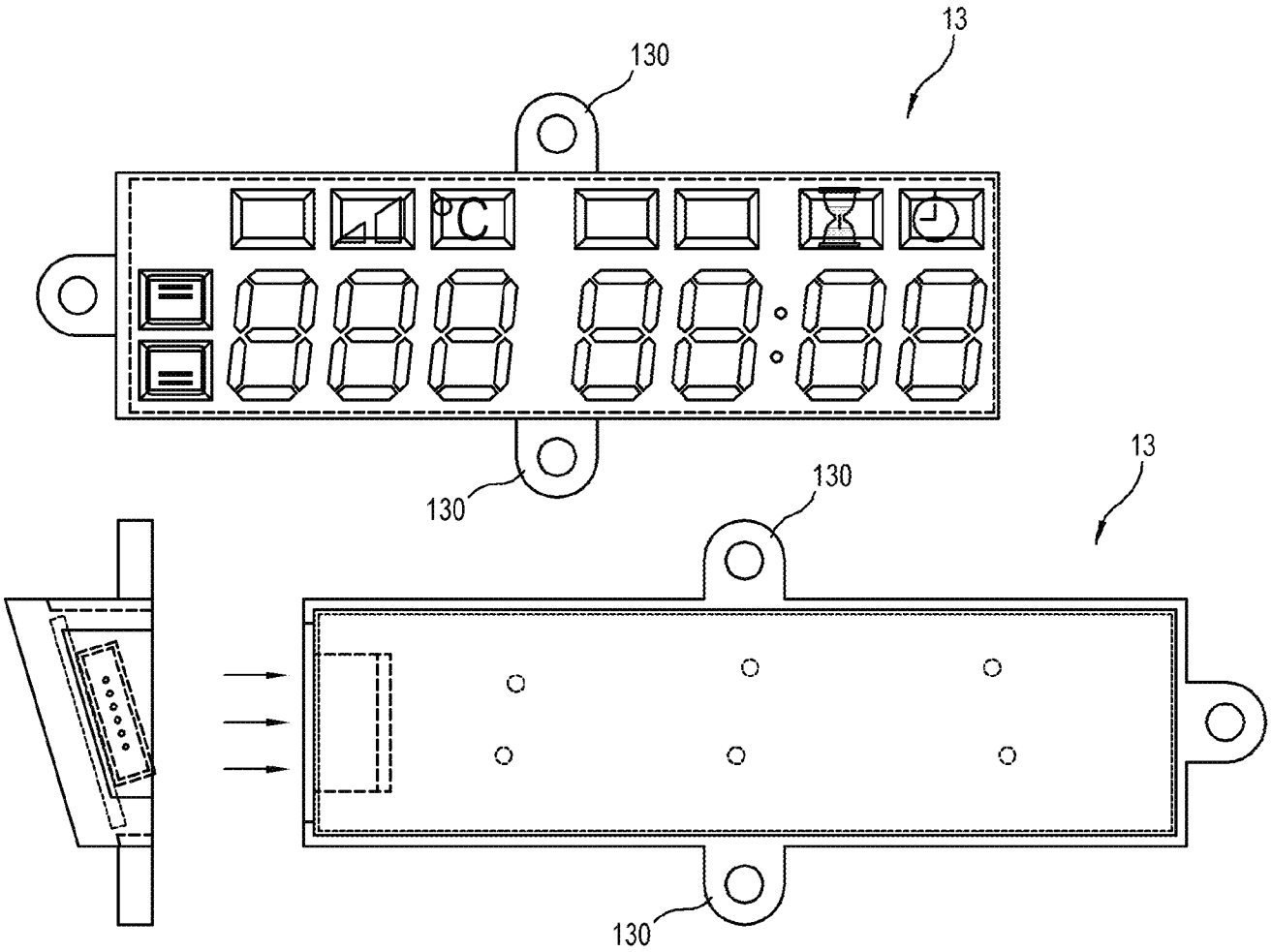
FIG. 13 shows an example of a structure for fastening a display module according to one embodiment of the disclosure.

Second, as shown in FIG. 13, a screw hole 130 is provided in a lower end portion of the second display 13, and a screw (not shown) is used to fasten the second display 13 to the aluminum plate 42.

Third, the second display 13 may be attached to the aluminum plate 42. In this case, the bottom of the second display 13 is flat, and a double-sided tape or the like may be for example used to attach the bottom of the second display 13 to the aluminum plate 42.

Figure 7:
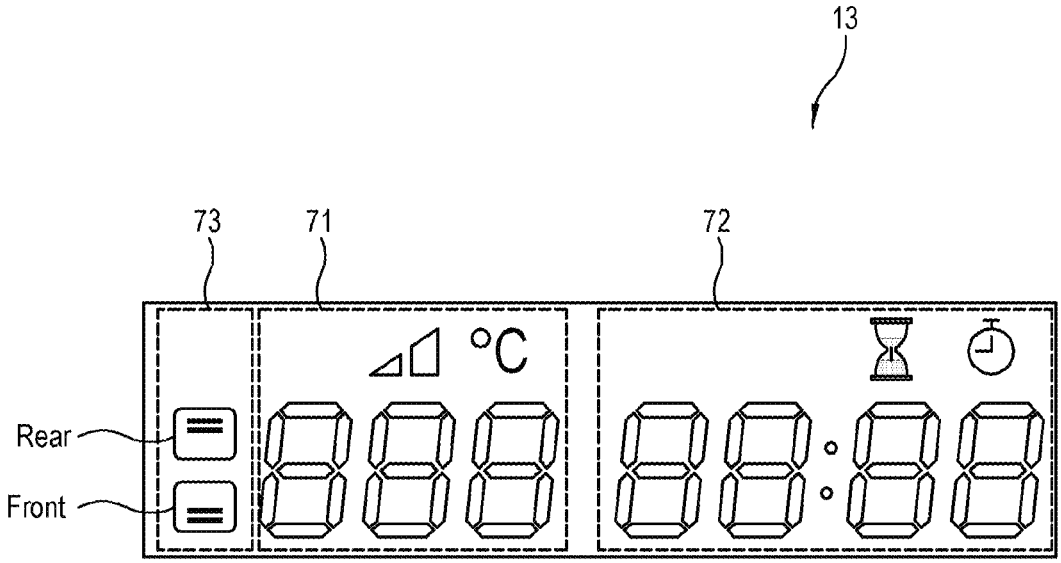
FIG. 7 shows an example of displaying cooking information about a burner on a display according to one embodiment of the disclosure.

FIG. 7 shows an example of displaying cooking information about a burner on a display according to one embodiment of the disclosure. As shown in FIG. 7, the induction heating cooker 10 according to the disclosure displays the cooking information about at least one burner 11 on the second display 13. The second display 13 may correspond to each of at least one burner 11, or may correspond to two or more burners 11.

In terms of displaying the cooking information, the second display 13 may display at least one among the output level, the output strength, the setting time, the operating time, the timer of the burner 11, the temperature of the burner 11, or the position of the burner 11.

In the shown example, the second display 13 is divided into a first display area 71, a second display area 72 and a third display area 73, and displays different cooking information on the display areas. According to one embodiment, the first display area 71 may display one among the output level, the output strength and the temperature, and the second display area 72 may display the setting time or the operating time. Further, the third display area 73 may display the position of the burner 11 corresponding to the cooking information displayed on the first display area 71 and the second display area 72.

For example, the first display area 71 may display the output level or the output strength while the burner 11 is operating, and may display a temperature or residual heat symbol h or H while the burner 11 stops operating.

Further, the second display area 72 may display time information such as a cooking setting time or an operating of the burner 11. In this case, icons respectively corresponding to the output level, the temperature, the operating time and the setting time are displayed above the first display area 71 and the second display area 72, thereby informing what cooking information the currently displaying numeral indicates.

The third display area 73 may display the positions Front or Rear of the burner 11 in the form of an icon, corresponding to the cooking information currently displayed among one or more burners 11.

According to one embodiment, the second display 13 may additionally display a text to at least one among an upper, lower, left and right sides of each display area 71 or 72 so that a user can be informed of the numeral or icon displayed on each of the display areas 71, 72 and 73.

Besides the foregoing cooking information, the second display 13 may provide various useful pieces of information to a user by a numeral, a letter and the like text, or an icon and the like image.

According to one embodiment, the controller 15 may set a color of the second display 13 in response to a user's control received through the handling portion 12. For example, a user may select a function of changing a color of an LED through the input section 121 in the handling portion 12, and thus choice a desired color, e.g. amber color, ice blue for the LED.

According to one embodiment, the controller 15 may change the color of the second display 13 in response to the cooking information displayed on the second display 13. For example, the color of the LED may be automatically changed in accordance with the output level corresponding to a user's control. For example, as the output level becomes higher, it is displayed gradually changing into dark red or blue colors so that a user can easily visually recognize the output level at a little far distance.

Figure 8:
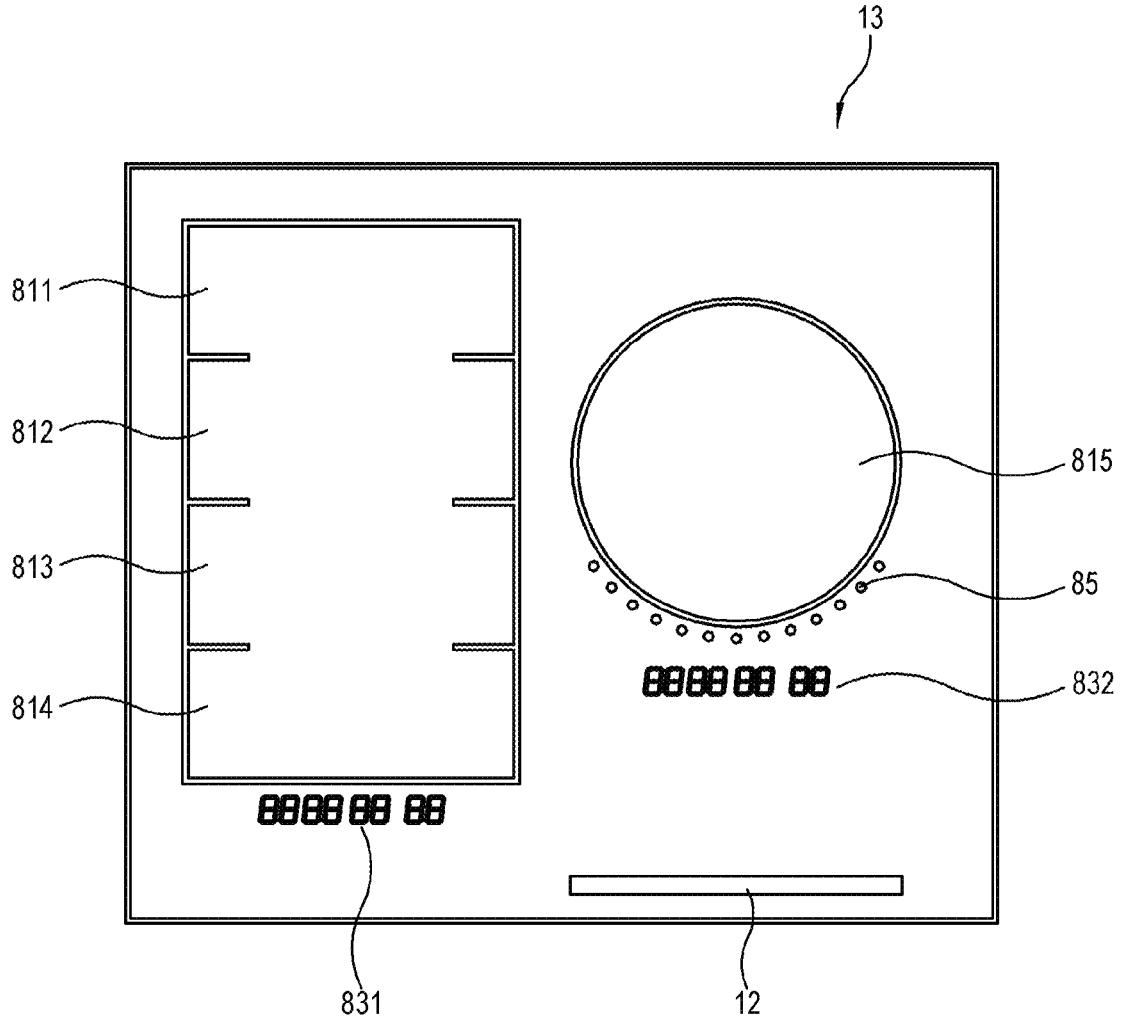
FIG. 8 shows an example of displaying a virtual flame for an operating burner according to one embodiment of the disclosure.

FIG. 8 shows an example of displaying a virtual flame for an operating burner according to one embodiment of the disclosure. As shown in FIG. 8, the induction heating cooker 10 according to the disclosure includes two second displays 831 and 832 for displaying the cooking information about a plurality of burners 811, 812, 813, 814 and 815 in a separate area divided from the handling portion 12. In this case, the second display 831 displays the cooking information about the four left first burners 811, 812, 813 and 814, and the second display 832 displays the cooking information about the right second burner 815.

In the shown example, the induction heating cooker 10 further includes the third display 85 below the second burner 815 in addition to the two second displays 831 and 832. Here, the third display 85 may be for example materialized like a pattern of a flame (i.e. a virtual flame) varied in shape or type depending on the cooking information of the corresponding second burner 815. For example, the shape or color of the flame may be varied depending on the output level of the second burner 815.

According to one embodiment of the disclosure, the induction heating cooker 10 may include the second display 13 and the third display 85 configured as separate modules or assembled into a single module. When the second display 13 and the third display 85 are integrated into one, it is possible to improve productivity and reduce costs since one display module performs two functions.

Figure 10:
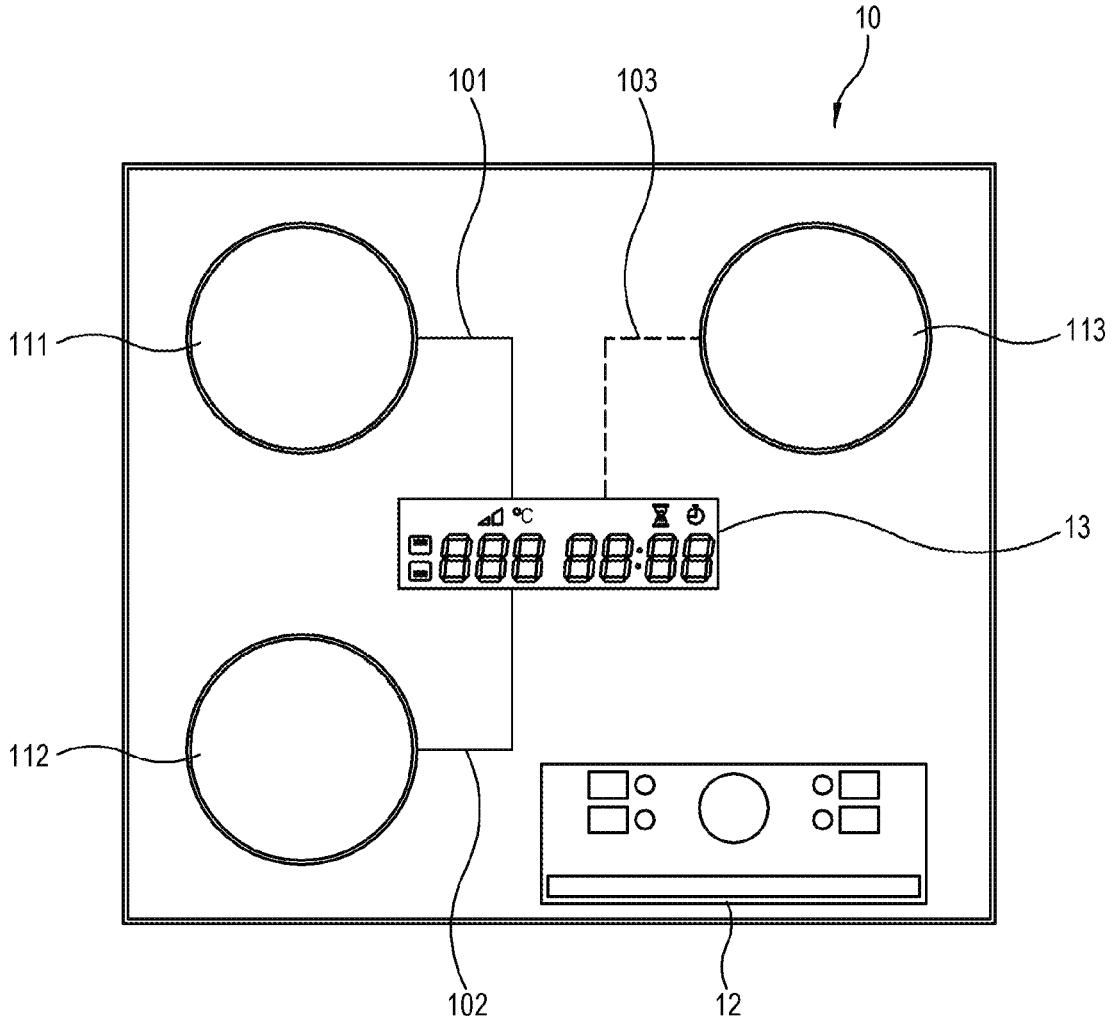
FIG. 10 shows an example of displaying a local relation of a burner corresponding to a display among two or more burners according to one embodiment of the disclosure.

FIG. 10 shows an example of displaying a local relation of a burner corresponding to a display among two or more burners according to one embodiment of the disclosure. As shown in FIG. 10, the induction heating cooker 10 according to the disclosure may further include fourth displays 101, 102 and 103 for displaying a local relation between the second display 13 and the corresponding burners 111, 112 and 113.

In the shown example, the second display 13 is configured to alternately display the cooking information about three burners 111, 112 and 113. In this case, the fourth displays 101, 102 and 103 are configured to indicate where the corresponding burner is positioned, thereby showing what burner the cooking information displayed on the second display 13 corresponds to For example, while the second display 13 is displaying the cooking information of the third burner 113, the fourth display 103 may blink as a line of connecting the second display 13 and the third burner 113.

Figure 11:
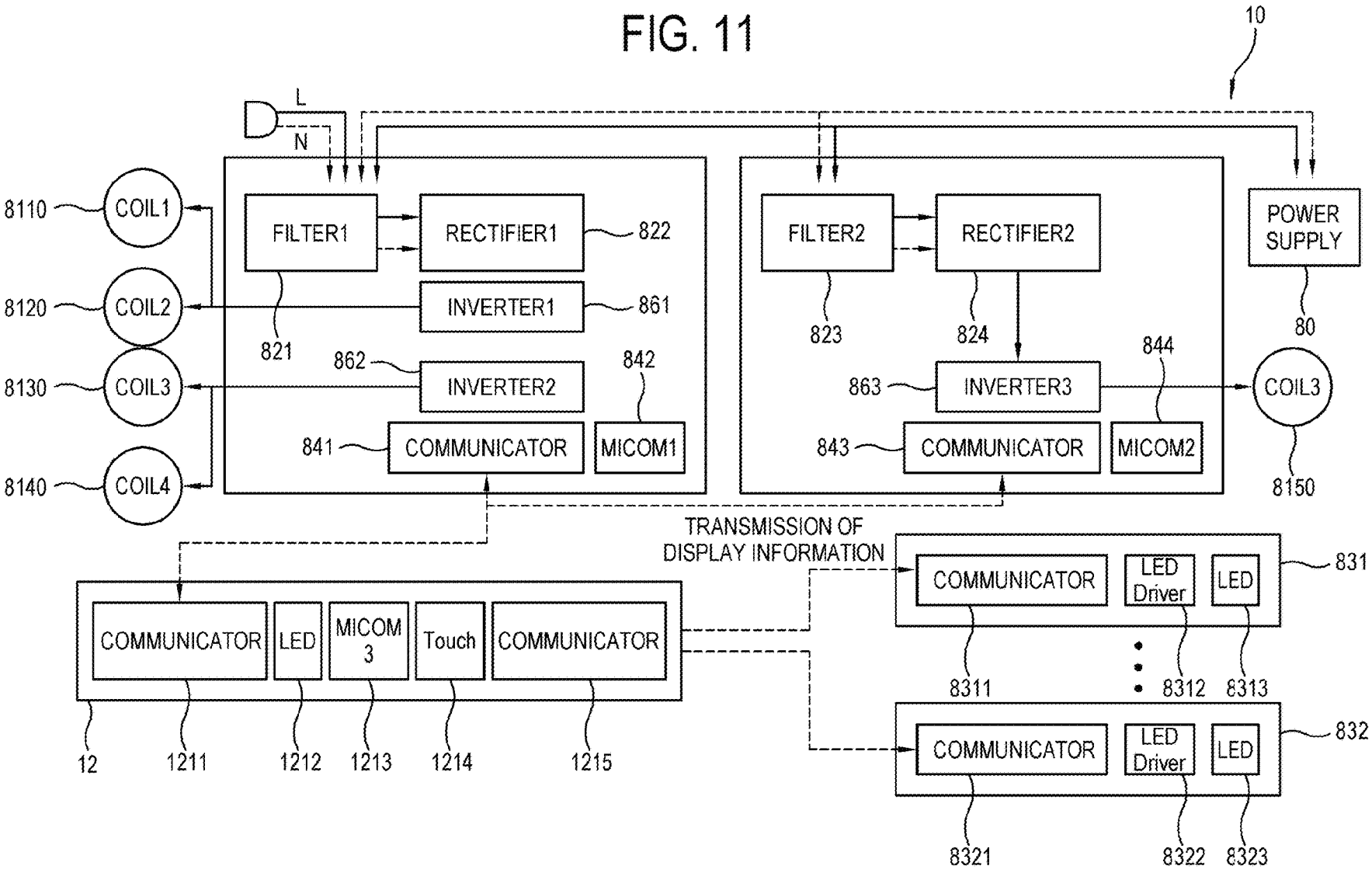
FIG. 11 illustrates a block diagram of a circuit in an induction heating cooker according to one embodiment of the disclosure.

FIG. 11 illustrates a block diagram of a circuit in an induction heating cooker according to one embodiment of the disclosure. In the shown example, the induction heating cooker 10 is equivalent to that of FIG. 8, and includes five burners 811, 812, 813, 814 and 815, the handling portion 12, and two second displays 831 and 832.

Filters 821 and 823 are configured to filter out electromagnetic interference (EMI) noise from input AC power, and rectifiers 822 and 824 rectify the AC power subjected to the filtering to thereby convert an AC voltage into a DC voltage.

Inverters 861, 862 and 863 converts a level of the DC voltage output from the rectifiers 822 and 824 and applies voltages having converted levels to coils 8110, 8120, 8130, 8140 and 8150.

As described above, when the power is supplied to at least one among the coils 8110, 8120, 8130, 8140 and 8150, the corresponding coil generates a resonance voltage and induces an eddy current, thereby heating a container put on the burners 811, 812, 813, 814 and 815.

The handling portion 12 receives a user's control through a touch pad 1214, and transmits a command corresponding to a user's control to microcomputers (Micom) 842 and 844 through a communicator 1211. Thus, the microcomputers 842 and 844 control the burner corresponding to a user's control among five burners 811, 812, 813, 814 and 815 to perform a heating operation.

A microcomputer 1213 in the handling portion 12 transmits the cooking information about the burner 811, 812, 813, 814 or 815, which is operating in response to a user's control, to two second displays 831 and 832 through a communicator 1215. In this case, the communicator 1215 of the handling portion 12 communicates with the communicator 8311 and 8321 of the second displays 831 and 832 by serial communication or universal asynchronous receiver/transmitter (UART) communication.

In case of using the serial communication, one electric wire is used to transmit the cooking information in sequence bit by bit. In case of using the UART communication, the cooking information is transmitted by converting parallel data into serial data in units of 8 bits at most.

The communication between the handling portion 12 and the second displays 831 and 832 is not limited to the serial or UART communication, but may be formed by other communication methods.

The second displays 831 and 832 drive LED drivers 8312 and 8322 to display the cooking information received from the handling portion 12 on LEDs 8313 and 8323.

As described above, according to the disclosure, it is easily recognized whether the burner being in use operates or not, and provide various pieces of cooking information about the operating burner.

As described above, according to the disclosure, a user can easily recognize whether a burner being in use operates or not.

Further, according to the disclosure, it is possible to intuitively recognize an operation of a burner since various pieces of cooking information about the operating burner are provided.

Further, according to the disclosure, there is provided a display having a structure of improving an esthetic function when the cooking information about the burner is provided.

Although the present disclosure has been described with various embodiments, various changes and modifications may be suggested to one skilled in the art. It is intended that the present disclosure encompass such changes and modifications as fall within the scope of the appended claims.

What is claimed is:

1. An induction heating cooker comprising:

a burner comprising a coil;

a handling portion provided in a predetermined area separated from the burner and comprising an input section for receiving a control of a user and a first display for displaying information corresponding to the control of the user;

a glass flat plate comprising a cooking area for the burner;

a second display attached to a metal plate provided below the glass flat plate in an area separated from the handling portion, where the metal plate is parallel to the glass flat plate and the second display is attached to the metal plate at an inclined angle; and a controller configured to control the second display to display cooking information about the burner.

2. The induction heating cooker according to claim 1, wherein the controller is configured to control the second display to display a temperature of the glass flat plate.

3. The induction heating cooker according to claim 2, wherein:

the second display comprises a holder provided in a bottom thereof, and the holder is configured to be inserted in the metal plate provided under the glass flat plate.

4. The induction heating cooker according to claim 2, wherein:

the second display comprises a screw hole in a lower end portion thereof, and the second display is configured to fasten, using a screw, to the metal plate provided under the glass flat plate.

5. The induction heating cooker according to claim 2, wherein the coil is mounted on the metal plate provided under the glass flat plate.

6. The induction heating cooker according to claim 1, wherein the second display is provided at a position spaced apart from the coil by more than a predetermined distance.

7. The induction heating cooker according to claim 1, wherein the second display is provided in each position corresponding to a relevant burner of the burner.

8. The induction heating cooker according to claim 1, wherein the second display comprises a display surface inclined at a predetermined angle to a horizontal surface of the cooking area for the burner.

9. The induction heating cooker according to claim 1, wherein the cooking information comprises at least one of an output level, an output strength, a setting time, an operating time, a timer of the burner, a temperature of the burner, or a position of the burner.

10. The induction heating cooker according to claim 1, wherein the second display represents the cooking information by a text comprising at least one of a numeral or a letter.

11. The induction heating cooker according to claim 1, further comprising a third display that is variable in shape or type, wherein the controller is configured to control the third display to be varied in shape or type depending on the cooking information.

12. The induction heating cooker according to claim 1, further comprising a communicator configured to communicate with a separate sensor, wherein the controller is configured to receive the cooking information from the separate sensor through the communicator.

13. The induction heating cooker according to claim 1, wherein the controller is configured to set a color of the second display in accordance with the control of the user received through the handling portion.

14. The induction heating cooker according to claim 1, wherein the controller is configured to change a color of the second display in accordance with the cooking information.

15. The induction heating cooker according to claim 1, wherein the controller is configured to control the second display to alternately display the cooking information of the burner.

16. The induction heating cooker according to claim 15, further comprising a fourth display configured to display a local relation between the second display and the burner.

17. The induction heating cooker according to claim 1, wherein the metal plate comprises an aluminum plate.

18. A method of controlling a display of an induction heating cooker, the method comprising:

receiving a control of a user for a burner through a handling portion;

displaying information corresponding to the received control of the user on a first display; and displaying cooking information about the burner on a second display, wherein the induction heating cooker comprises:

the burner comprising a coil, the handling portion provided in a predetermined area separated from the burner and comprising an input section for receiving the control of the user, the first display, a glass flat plate comprising a cooking area for the burner, and the second display attached to a metal plate provided below the glass flat plate in an area separated from the handling portion, where the metal plate is parallel to the glass flat plate and the second display is attached to the metal plate at an inclined angle.

19. The method according to claim 18, wherein the cooking information comprises at least one of an output level, an output strength, a setting time, an operating time, a timer of the burner, a temperature of the burner, or a position of the burner.

20. The method according to claim 18, wherein the second display represents the cooking information by a text comprising at least one of a numeral or a letter.

21. The method according to claim 18, wherein:

the induction heating cooker further comprises a third display variable in shape or type, and the method further comprises controlling the third display to be varied in shape or type depending on the cooking information.

22. The method according to claim 18, wherein the metal plate comprises an aluminum plate.

* * * * *